United States Patent [19]

Barlow et al.

[11] 4,250,657

[45] Feb. 17, 1981

[54] AIR CITY GAME

[75] Inventors: Gordon A. Barlow, Evanston; Anthony Janiszewski, Elmwood Park, both of Ill.

[73] Assignee: Gordon Barlow Design, Skokie, Ill.

[21] Appl. No.: 955,912

[22] Filed: Oct. 30, 1978

[51] Int. Cl.[3] ..... A63H 29/16

[52] U.S. Cl. ..... 46/44; 104/155; 406/108

[58] Field of Search ..... 46/44; 104/155; 406/147, 108, 112; 273/86 D; 40/412

[56] References Cited

U.S. PATENT DOCUMENTS

| | | | |
|---|---|---|---|
| 411,333 | 9/1889 | Given et al. | 406/147 X |
| 975,230 | 11/1910 | Hagen | 406/108 |
| 2,003,257 | 5/1935 | Fageol et al. | 406/112 |
| 2,890,537 | 6/1959 | Benko | 46/44 UX |
| 3,469,340 | 9/1969 | Breneman et al. | 46/44 |
| 3,697,071 | 10/1972 | Anderson | 46/44 X |
| 3,711,038 | 1/1973 | Van Otteren | 406/112 X |

FOREIGN PATENT DOCUMENTS

| | | | |
|---|---|---|---|
| 1217281 | 5/1966 | Fed. Rep. of Germany | 406/112 |

*Primary Examiner*—Louis G. Mancene
*Assistant Examiner*—Mickey Yu
*Attorney, Agent, or Firm*—Alter and Weiss

[57] ABSTRACT

A game comprising an air tube transportation system energized by a unique air pump system. The air pump system includes an air pump manifolded into a plurality of tubes wherein each of the tubes is selectively connected to the air pump through individual valves which control the direction and force of the air flowing through the tubes.

7 Claims, 13 Drawing Figures

AIR CITY GAME

BACKGROUND OF THE INVENTION

This invention is concerned with game devices; and more particularly, with game devices including tubes and the means for transporting objects through the tubes.

The transportation of objects through tubes responsive to air pressure has been known for a long time. Games have been devised utilizing air pressure forces as the motivating forces on "cars", "rocket ships" and the like for transporting them through transparent tubes in a loop. It has also been known, for a long time, that games hold the interest of a player when there are moving objects integral to the game and the interest is increased when the moving objects can be controlled in a variety of ways.

In the past using compressed air for controlling objects being transported through tubes has not been too successful. The systems devised in the past have been complicated and expensive and have not featured the capability of moving the objects in the tube in a variety of directions and/or controlling them to stop the movement.

Accordingly, an object of the present invention is to provide new and unique air transportation games.

A related object of the present invention is to provide air transportation games wherein the objects being transported can be moved in a variety of directions; i.e., outward horizontally, outward vertically, inward horizontally, inward vertically or held in a stationary position vertically or held in a stationary position, when biased at an angle.

Yet another object of the present invention is to provide unique air pump devices for powering compressed air transportation system games.

Still another object of the present invention is to provide a single air pump for selectively forcing air through a multiplicity of transparent tubes of thereby force objects through the tubes.

Still another object of the present invention is to include individual valve control means associated with each of the air tubes.

Yet another object of the present invention is to provide rotary means motivated to rotate by the air pressure through a selected tube indicating air pressure is being sent through or drawn through the selected tube.

Yet another object of the present invention is to provide unique parking systems for receiving the objects sent through the tubes and for feeding the objects into the tubes.

SUMMARY OF THE INVENTION

In accordance with a preferred embodiment of the present invention an air pump device is provided leading to a multiplicity of tubes. The air pump device comprises an impeller type pumping arrangement having a manifold attached thereto. The manifold couples the pump to a plurality of tubes. One of the tubes is vertically arranged, while other of the tubes are basically horizontally arranged. The vertical tube terminates in a propeller type device rotating, when the air is directed through the tube. A platform at the top of the vertical tubes is designed to receive the objects transported through the tube.

The horizontal tubes each terminate in a different type of parking arrangement. One type of parking arrangement automatically is changed from a horizontal position to a vertical position responsive to receipt of an object from the tube. The other type of parking device comprising a plurality of receiving tubes, which can be selectively placed in front of the transporation tubes. Individual valves selectively couple each of the tubes to the pump. The valves control the direction of the compressed air so that the pumped air either is going into the tubes or being drawn from the tubes or the tubes are selectively disconnected from the pump. Additionally, air can be directed through the pump at a controlled rate so as to, for example, hold an object in the vertical tube suspended against the force of gravity.

DESCRIPTION OF FIGURES

These and other objects and features of the present invention will be best understood by making reference to the accompanying drawings; wherein.

DESCRIPTION OF PREFERRED EMBODIMENT

Figure 1:
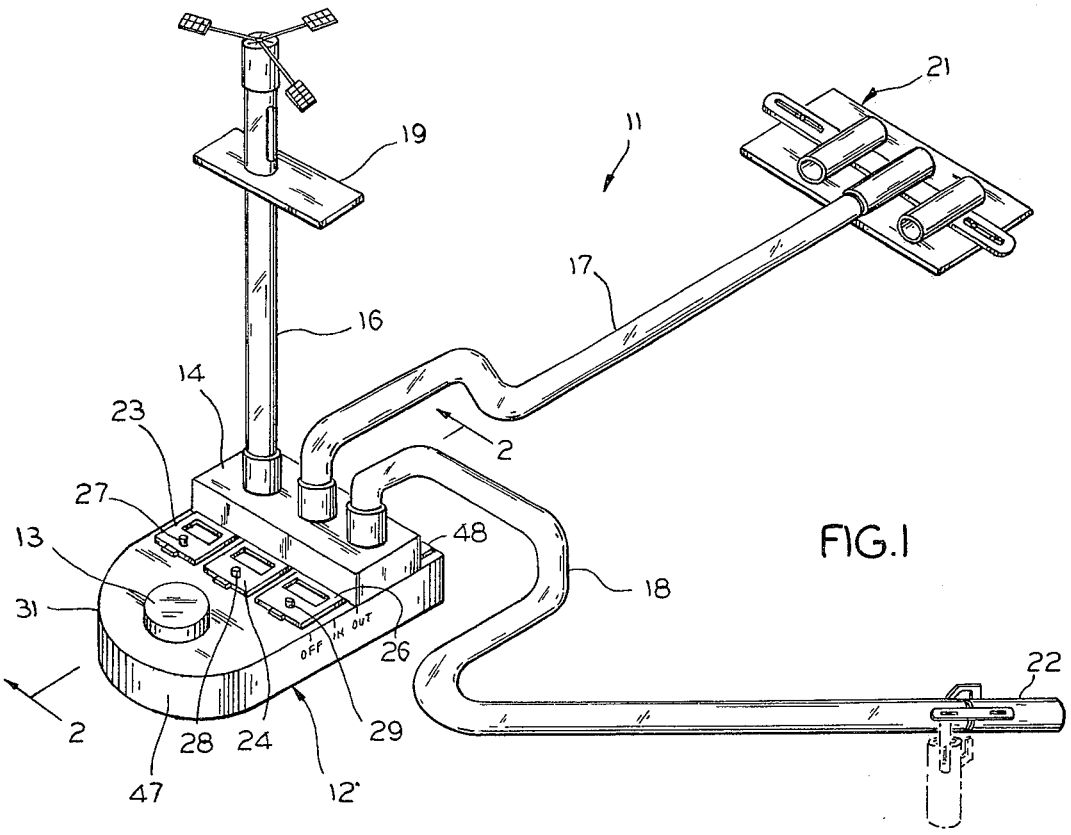
FIG. 1 is a pictorial showing of one embodiment of an air city game.

In FIG. 1 the air city game is shown pictorially as 11. The game comprises a pump or air compressor device 12. The pump device includes a pump motor 13 and a manifold section 14. The manifold section has a plurality of transportation tubes directed therefrom. Preferably the transportation tubes are transparent and are shown as vertical tube 16, first horizontal tube 17 and second horizontal tube 18.

The tubes each terminate in some type of parking device. The parking device in tube 16, for example, is platform 19. The parking device at the termination of tube 17 is comprised of a plurality of parking tubes, shown generally as 21. The parking device terminating tube 18 is indicated as parking tube 22.

The air flow through each of the tubes is controlled by a valve arrangement individual to that tube. Thus, there are shown valve controls 23, 24 and 26 for tubes 16, 17 and 18, respectively. Means are provided for moving the valve controls, such as, for example, the knobs 27, 28 and 29, respectively for valves 23, 24 and 26.

Figure 2:
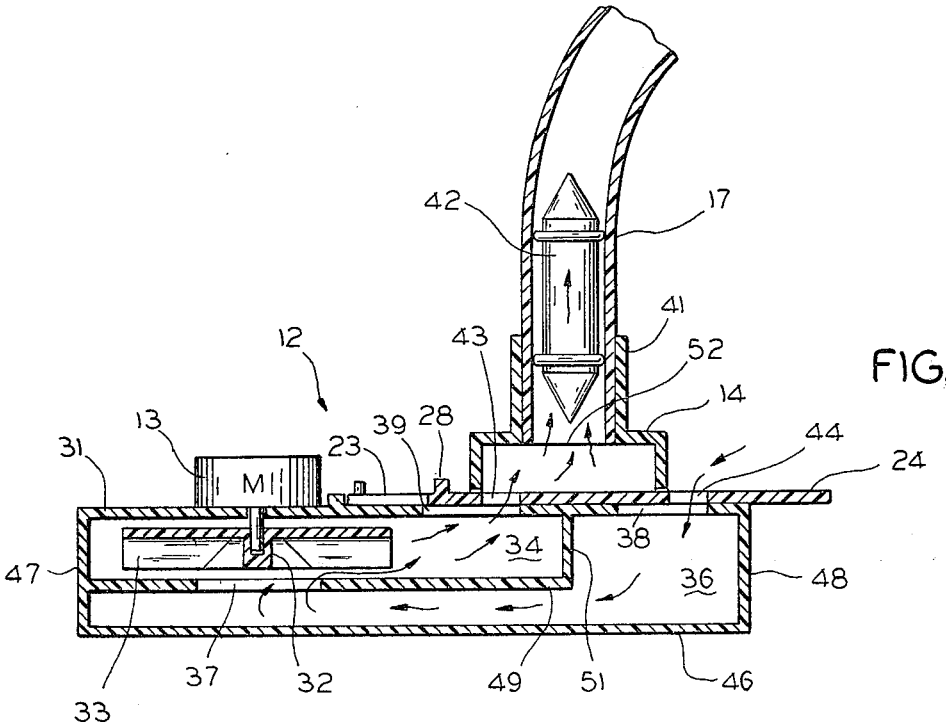
FIG. 2 is a partial sectional view of the air pump device taken at a plane passing through line 2—2 of FIG. 1 and looking in the direction of the arrows.

Details of the pump device 12 are better seen in FIG. 2. Therein the motor 13 which may be battery operated, spring operated or operated by alternating current is mounted on the top surface 31 of the device 12 by any well known means. A drive shaft 32 is shown protruding downwardly from the motor 13 and is coupled to an air driving device, such as impeller 33.

The impeller 33 is coupled to the drive shaft 32, in any well known manner, such as by press-fitting or by the use of a key (not shown). The impeller is located in an impeller chamber shown as 34. A second or control chamber 36 surrounds the impeller chamber 34. The control chamber and the impeller chamber are coupled together through aperture 37. Air passage apertures are provided at the top of the intake chamber and at the top of the control chamber. These air passage apertures are indicated as control chamber aperture 38 and impeller chamber aperture 39.

Attached to the top surface 31 of the air pump device is the manifold 14. The manifold 14 includes a plurality of coupling tubes either integral to the manifold section or attached thereto such as coupling tube 41. Attached within the coupling tube 41 is the transportation tube 17, which is preferably transparent. An object being transported, such as object 42, is shown within tube 17.

The valve means for each of the individual tubes is provided and is shown in FIG. 2 as the valve means 24. The valve means, as can be seen in FIG. 2, includes two apertures—apertures 43 and 44. These apertures are used to control the direction and the pressure of the air in the tube. More particularly, when the valve is pushed inward towards the manifold, as shown in FIG. 2, by, for example, pushing on post 28, until aperture 43 is lined up in the manifold section 14 with the aperture 39 of the impeller chamber and aperture 44 is aligned with the control chamber aperture 38, then the compressed air flows in the direction shown by the arrows.

The air path extends from the ambient air external to the pump device through aperture 44, aperture 38, into the control chamber 36, through aperture 37 where it is forced by the impeller through apertures 39 and 43 into the manifold and up through tube 17. When there is an object, such as object 42, which circumferentially abuts the interior circumference of the tube, then the object 42 is forced away from the pump unit through the tube towards the landing device 21.

The pump device has a base 46 which comprises the bottom of the control chamber 36. As shown in FIG. 1, the pump device is U-shaped with the arcuate portion of the U comprising a wall 47 extending upward from the base 46. The arcuate portion 47 is at the impeller side of the pump unit. A flat wall 48 extending upwardly from the floor 46 closes the U. The walls 47 and 48 join the floor to the top surface 31.

The impeller chamber, as well as the control chamber, both share the wall 27. The impeller chamber is divided from the control chamber by a floor 49 and a wall 51, which is preferably parallel to the wall 48.

Figure 3:
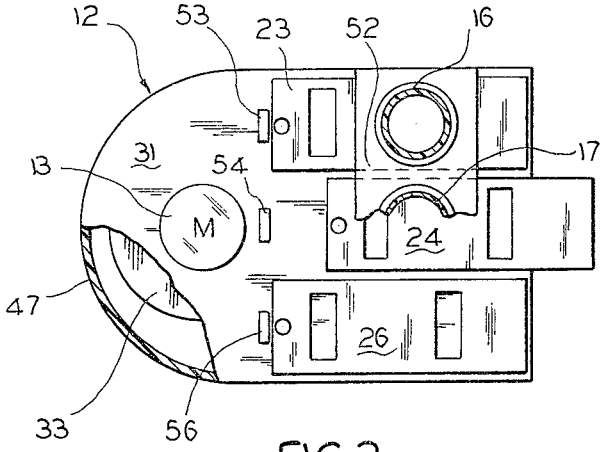
FIG. 3 is a partial sectional plan view of the air pump device of FIG. 2.
Figure 4:
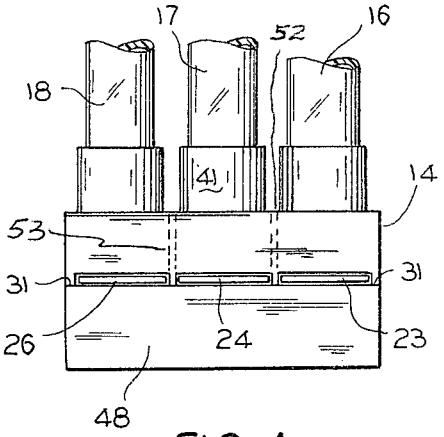
FIG. 4 is a back view of the air pump device showing the three tubes rising therefrom and the valve controls.

As seen particularly in FIGS. 3 and 4, the manifold 14 is divided into sections by bulkheads, such as bulkhead 52, between the section of the manifold leading to tube 16 and the section of the manifold leading to tube 17. In FIG. 4 it is seen that there is another bulkhead 53 provided between the sections of the manifold supporting and leading to tubes 17 and 18.

In FIG. 3, the valves 23 and 26 are shown in the closed position—ie., isolating the associated tubes from the flow of any air; while the valve 24 is shown in the open position—ie.,causing air to be forced out through the tube 17. It is noted that stop means are provided for stopping each of the valves in the closed or off position. The stops are abutments 53, 54 and 56 used with valves 23, 24 and 26, respectively.

Each of the valves are seen in the side view of FIG. 4 as being fitted within slots in the wall 28, at the surface 31 of the base unit 12.

Figure 5:
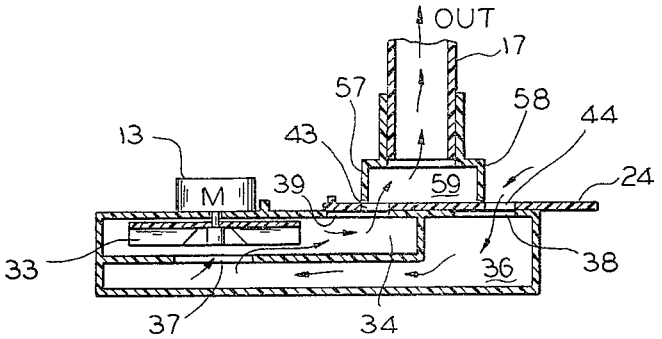
FIGS. 5, 6 and 7 are sectional views showing the different positions of the valve arrangements.
Figure 6:
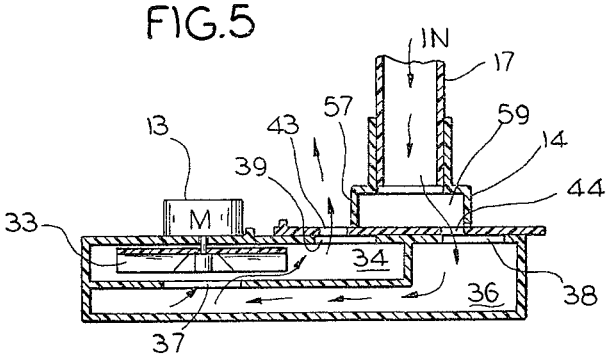
Figure 7:
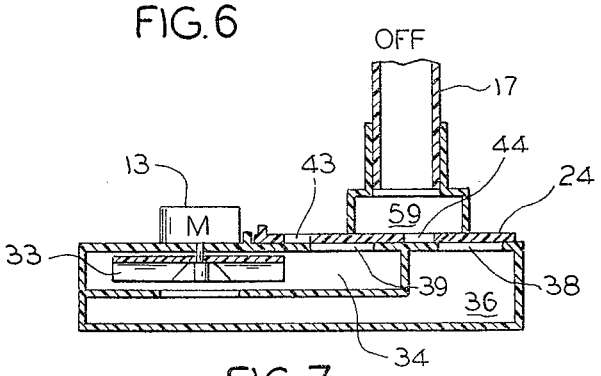

FIGS. 5, 6 and 7 detail the basic positions of the valves. More particularly, FIG. 5 shows the position of the valve forcing air outward through the tube. This is the same position in which the pump device is shown in FIG. 2.

The apertures 39 and 38 in the top surface 31 of the pump unit are sufficiently large to extend beyond the walls of the manifold section to the ambient open air. The apertures 43 and 44 of the valve itself are smaller than the apertures 38 and 39.

It should be noted that, if the aperture of the valve is set so that part of it extends underneath the manifold and part of it extends into the open air, the amount of air being forced through the tube can be adjusted so that if, for example, aperture 43 is extended slightly past the pump side wall 57 of the manifold section 14, while aperture 44 is extended slightly under the outside wall 58 of the manifold, then the amount of air being forced through the tube 17 is less than the amount when the valve is set as shown in FIG. 5. The amount of air forced through the tubes, thus is adjustable to exactly counterbalance the effect of gravity on the object, such as rocket 42, shown in FIG. 2. In this manner the rocket 42 can be held suspended in tube 16, for example.

As shown in FIG. 5, the air is pulled through the aligned apertures 44 and 38 into the control chamber through aperture 37, driven by the impeller through the aligned apertures 43 and 39 into the manifold chamber 59 and out through tube 17 with the velocity of air being controlled by the positioning of the valve 24.

In FIG. 6 the valve is set so that the apertures 43 and 39 are aligned outside of, or closer to the motor, than wall 57 of the manifold 14; while the apertures 44 and 38 are aligned within the manifold chamber 59. In that instance, the air is then pulled into and through the tube 17, into the manifold chamber 59, through the aligned apertures 44 and 38, into control chamber 35, through aperture 37 into the inner impeller chamber 34 and out through the aligned apertures 43 and 39 into the ambient air. Thus, the direction of rotation of the rotor or the impeller 33 is not changed, but the direction of the air flow is changed.

Finally, FIG. 7 shows the position of the valve in the off position, when no air is allowed to pass through the tube 17. In this case, apertures of the valve 24 are not aligned with the apertures in surface 31. Therefore, the apertures of the pump unit are blocked from the tube and no air is allowed to go into or come out of the tube.

Another stop position is where the apertures 43 and 44 are each equally into and out of the manifold chamber 59 so that the outward and inward pull of air through the tubes is equally balanced and therefore no air flows through the tube.

Figure 8:
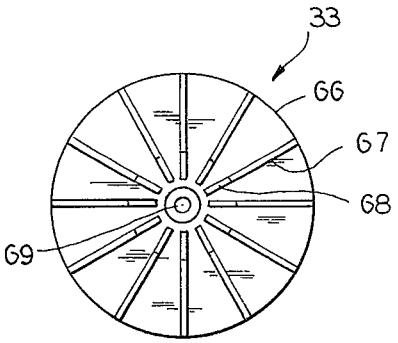
FIG. 8 is a plan view of the impeller of the pump.

FIG. 8 shows a plan view of a preferred embodiment of the impeller. The impeller comprises a base unit 66 having fins, such as fin 67, extending from and normal to the base. The fins are biased at their end, such as the biased end 68 of fin 67. The impeller of FIG. 8 is shown as having a hub section 69 for receiving shaft 32 of the motor in any well known manner.

It should be understood that the impeller of FIG. 8 can assume many different shapes and still remain within the scope of this invention. The point is that it directs and forces the air.

Figure 9:
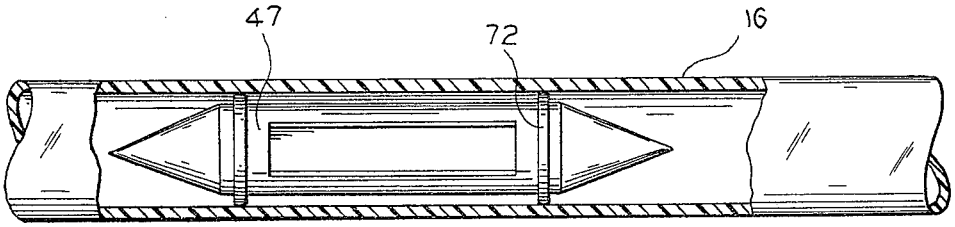
FIGS. 9 and 10 are partial sectional views of the tubes showing objects inside the tubes which may be transported through the tubes.
Figure 10:
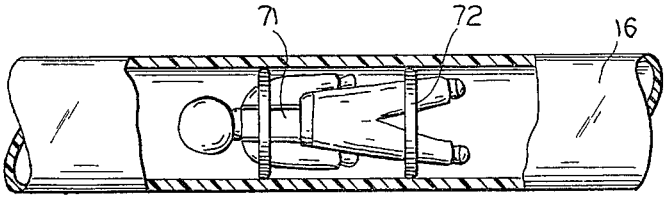

FIGS. 9 and 10 show different objects within the tube shafts, for example, the object shown in tube 16 of FIG. 9 is the rocket 42. A humanoid 71 is shown in FIG. 10 as the object being transported through the vertical tube 16. It is noted that each of the objects used to be transported through the tubes has means, such as circumferential abutting surfaces 72, provided. These surfaces, of course, extend to abut the insides of the tubes and trap the air, whether it is coming in or going out of the tubes, so as to use the force of the air to move the object.

Figure 11:
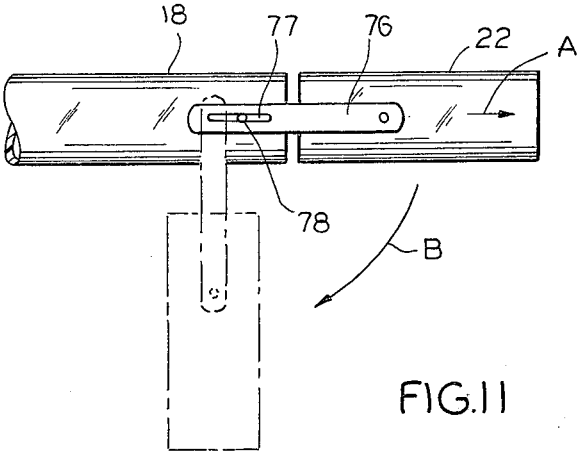
FIGS. 11 and 12 are showings of different parking devices useful with the game.

FIG. 11 shows details of the parking device 22 of FIG. 1. As shown in FIG. 11, the parking device 22 is attached to transportation tube 18 with a pair of pivotally extending arms, such as arm 76. The arm 76 is attached to tube 16 by a groove pin 78 in the slot 77 in the arm. Normally, the parking means 22 is pushed inward on the arm so that the groove pin 78 fits within the groove and the parking means 22 abuts the end of the tube 18 to keep the parking means 22 in a vertical position. However, when an object, such as rocket 42, is projected outwardly from the tube 18 into the parking means the momentum of the object causes parking means 22 to move initially in the direction of the arrow A and the groove 77 of arm 76 moves until parking means 22 falls free of tube 18 and is forced downward in the path shown by arrow B until it assumes the vertical position, shown by the dashed lines of FIG. 11.

When it is desired to once again send the rocket 42 into the tube, the rocket 42 is put into parking means 22 and the parking tube 22 is moved backwards opposite of direction B in the horizontal position and pushed along slot 77 so that parking tube 22 once again abuts tube 18 and is prevented from returning to the vertical position. The valve is then operated to cause suction in tube 18 and the rocket is pulled out of the parking place 22.

Figure 12:
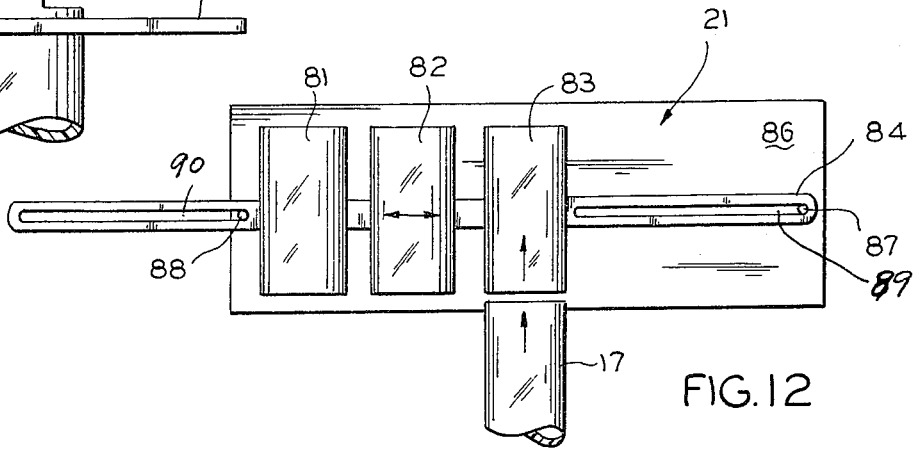

The parking means 21 of FIG. 1 is shown in greater detail in FIG. 12. Herein, it is shown that the parking means comprises a plurality of parking tubes, such as tubes 81, 82 and 83. The device 21 is shown with tube 83 aligned with tube 17. The alignment is made by merely moving the slotted band 84 along base 86 in the track defined by pins 87 and 88 in grooves 89, 90 until the desired parking tube is aligned with the propulsion or transportion tube 17.

Different types of objects, such as rocket ships, space ships or humanoid figures can be set into the parking tubes 81–83. It should be understood that the parking tubes 81–83 have to terminate in an apertured bulkhead of some sort or a screen to enable air to pass therethrough and yet be able to stop the object being transported.

Figure 13:
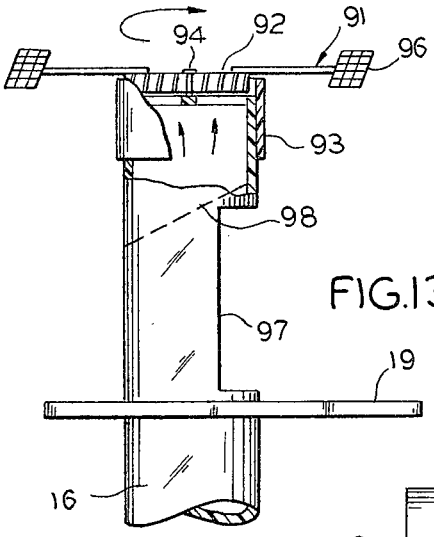
FIG. 13 shows details of the top of the vertical tube of FIG. 1.

FIG. 13 shows the parking platform 19 along with the details of the top of tube 16, shown in FIG. 1. As shown in FIG. 13 and in FIG. 1, a turbine driven radar station 91 is provided. The turbine is shown as turbine 92 and it is driven by air passing through tube 16. The platform shows the various devices that can be used, and one that is actually used in enlivening the air city game and providing it with a variety of moving parts to make it interesting.

The radar unit is mounted to tube 16 by simply fitting the cap section 93 over the tube. The cap section has the rotor means 92 pivotally mounted thereto on axle 94. The radar receptors are shown, for example, at 96. Immediately above platform 19 there is an access opening 97. This enables removing the object that is transported in tube 16 and placing them on the platform. Means can be provided within the tube for automatically causing the transported object to "land " on the platform, for example, a biased abutment 98 is provided which causes the rocket or object being transported to "land " on platform 19.

In operation the motor is turned on, the objects to be transported are placed within the unique landing means and the valves are operated to motivate the objects in a desired mode. The devices can be used in a multiplicity of ways, the only limitation being the imagination of the user.

While the principles of the invention have been described above in connection with specific apparatus and applications it is to be understood that this description is made by way of example only, and not as a limitation on the scope of the invention.

We claim:

1. A tube transportation system game;

said game comprising an air pump device for use in transporting objects in transportation tube means, said air pump device comprising a single motor driven impeller for generating unidirectional air flow, an impeller compartment surrounding said impeller, a control compartment juxtaposed to said impeller compartment, manifold means for coupling said air pump device to said tube means, first aperture means in said impeller compartment coupling said impeller compartment with both said manifold means and ambient air, second aperture means in said control compartment normally connecting said control compartment with both said manifold means and the ambient air, valve means for controlling the direction and the amount of the flow of air in said transportation tube means, said valve means selectively forcing air outward from said tube means or inward from said tube means, said valve means including a body section having first and second valve apertures therein, said first and second valve apertures being positioned and sized to enable selectively closing off said first and second apertures from either said ambient air or said manifold means or both, parking means at the end of said tube means, said parking means comprising an object passage aperture at one end of said tube means, said parking means further comprising platform means for automatically receiving an object transported from said tube means onto said platform means, and windmill means attached to the end of said tube means to rotate responsive to movement of air through said transportation tube means.

2. A tube transportation system game;

said game comprising an air pump device for providing compressed air for use in transporting objects in transporting tube means, said air pump device comprising a single motor driven impeller pump for generating unidirectional air flow, an impeller compartment surrounding said impeller, a control compartment juxtaposed to said impeller compartment, first aperture means in said impeller compartment coupling extending to simutaneously separately connect said impeller compartment with said tube means and ambient air, second aperture means in said control compartment extending to simultaneously separately connect said control compartment with said tube means and ambient air, and valve means controllably coupling said first and second apertures to said tube means and/or said ambient air.

3. The tube transportation system of claim 2 wherein said tube means comprises a plurality of tubes, and manifold means for coupling said plurality of tubes to said air pump device.

4. The game of claim 3 wherein said valve means includes a body section having first and second valve apertures therein, and said first and second valve apertures being positioned and sized to enable selectively closing off said first and second apertures from either said ambient air or said manifold means or both.

5. The game of claim 4 wherein said valve means comprises means for closing said air off from said tube means.

6. The game of claim 5 including parking means and wherein said parking means comprises an object passage aperture at one end of said tube means.

7. The game of claim 6 wherein said parking means further comprises parking tube means normally extending axially with said transportation tube means, and means for enabling said parking tube means to normally automatically assume a position 90° removed from said axial alignment responsive to the receipt of an object through said transportation tube means.

* * * * *